US012618218B2

(12) United States Patent
Sun et al.

(10) Patent No.: US 12,618,218 B2
(45) Date of Patent: May 5, 2026

(54) MODULAR EXCAVATOR

(71) Applicant: JIANGSU XCMG CONSTRUCTION MACHINERY RESEARCH INSTITUTE LTD., Xuzhou (CN)

(72) Inventors: Zhanrui Sun, Xuzhou (CN); Yong Li, Xuzhou (CN); Yong Zhang, Xuzhou (CN)

(73) Assignee: JIANGSU XCMG CONSTRUCTION MACHINERY RESEARCH INSTITUTE LTD., Xuzhou (CN)

( * ) Notice: Subject to any disclaimer, the term of this patent is extended or adjusted under 35 U.S.C. 154(b) by 412 days.

(21) Appl. No.: 18/272,073

(22) PCT Filed: Dec. 23, 2021

(86) PCT No.: PCT/CN2021/140801
§ 371 (c)(1),
(2) Date: Jul. 12, 2023

(87) PCT Pub. No.: WO2022/227643
PCT Pub. Date: Nov. 3, 2022

(65) Prior Publication Data

US 2024/0141613 A1 May 2, 2024

(30) Foreign Application Priority Data

Dec. 2, 2021 (CN) ..... 202111462384.5

(51) Int. Cl.
*E02F 3/32* (2006.01)
*E02F 3/36* (2006.01)
(Continued)

(52) U.S. Cl.
CPC ..... *E02F 3/32* (2013.01); *E02F 3/36* (2013.01); *E02F 9/02* (2013.01); *E02F 9/0808* (2013.01);
(Continued)

(58) Field of Classification Search
None
See application file for complete search history.

(56) References Cited

U.S. PATENT DOCUMENTS 7,744,333 B2 * 6/2010 Chaddock ..... B60P 1/6427 414/498
2004/0256342 A1 12/2004 Monteil et al.
(Continued)

FOREIGN PATENT DOCUMENTS

CA 2943995 A1 4/2017
CN 1138006 A 12/1996
(Continued)

OTHER PUBLICATIONS

International Search Report for PCT/CN2021/140801 mailed on Sep. 5, 2022 (7 pages including English Translation).
(Continued)

*Primary Examiner* — Michael S Lowe
(74) *Attorney, Agent, or Firm* — Merchant & Gould P.C.

(57) ABSTRACT

The present disclosure provides a modular excavator, including a plurality of assembly modules that are detachably connected, the plurality of assembly modules including: a frame turntable base module; a track beam assembly module connected to the frame turntable base module; a track module connected to the track beam assembly module; a slewing drive module connected to the frame turntable base module; a power assembly module connected to the frame turntable base module; a counterweight module connected to the power assembly module; a cab module connected to the frame turntable base module; a fuel tank module connected to the frame turntable base module; a boom assembly module connected to the frame turntable base module; a bucket arm assembly module connected to
(Continued)

the boom assembly module; and a work tool module connected to the bucket arm assembly module.

18 Claims, 8 Drawing Sheets

(51) Int. Cl.

| | |
|---|---|
| ***E02F 9/02*** | (2006.01) |
| ***E02F 9/08*** | (2006.01) |
| ***E02F 9/12*** | (2006.01) |
| ***E02F 9/16*** | (2006.01) |
| ***E02F 9/18*** | (2006.01) |

(52) U.S. Cl.
CPC ..... *E02F 9/0866* (2013.01); *E02F 9/0883* (2013.01); *E02F 9/121* (2013.01); *E02F 9/16* (2013.01); *E02F 9/18* (2013.01)

(56) References Cited

U.S. PATENT DOCUMENTS

| | | | |
|---|---|---|---|
| 2011/0253467 | A1 | 10/2011 | Bolz et al. |
| 2014/0212210 | A1 | 7/2014 | Robl et al. |
| 2017/0096181 | A1 | 4/2017 | Canossa et al. |
| 2018/0298583 | A1 | 10/2018 | Lehnhoff |

FOREIGN PATENT DOCUMENTS

| | | | |
|---|---|---|---|
| CN | 111074963 | A | 4/2020 |
| CN | 112832318 | A | 5/2021 |
| CN | 113216310 | A | 8/2021 |
| CN | 217150395 | U | 8/2022 |
| DE | 4219803 | A1 | 12/1993 |
| EP | 3401447 | A1 | 11/2018 |
| EP | 3770330 | A1 | 1/2021 |
| JP | H04312625 | A | 11/1992 |
| JP | 2014040722 | A | 3/2014 |

OTHER PUBLICATIONS

Written Opinion for PCT/CN2021/140801 mailed on Sep. 5, 2022 (5 pages).
Extended European Search Report dated Nov. 8, 2025 for EP Application No. 21939102.6 (10 pages).
Office Action dated Dec. 25, 2024 for corresponding CN Application No. 202111462384.5 (14 pages including English Translation).

* cited by examiner

MODULAR EXCAVATOR

CROSS-REFERENCE TO RELATED APPLICATIONS

This application is a National Stage Application of International Application No. PCT/CN2021/140801, filed 23 Dec. 2021, which claims benefit of Ser. No. 20/211, 1462384.5, filed 2 Dec. 2021 in China, and which applications are incorporated herein by reference. To the extent appropriate, a claim of priority is made to each of the above disclosed applications.

FIELD OF THE INVENTION

The present disclosure relates to the technical field of engineering machinery, and particularly to a modular excavator.

BACKGROUND OF THE INVENTION

Various types of natural disasters occur frequently in China, which seriously threatens the safety of people's lives and property. In the face of frequent occurrence of various natural disasters, construction machinery, as an important part of emergency rescue equipment, plays a major role in disaster rescue. In mild and some moderate natural disasters, transport facilities are damaged to a small degree, and large general construction machinery can be used to quickly repair roads and bridges and then carry out emergency rescue work in a wide range; and in rescue environments for some moderate and severe natural disasters which cause serious damage to roads and bridges or serious blockage of land transportation or where transportation is not convenient in remote mountainous areas, the existing means of air transport has limited transport capacity, and there is still no effective equipment that can quickly reach a rescue site, which seriously delays the emergency rescue progress.

SUMMARY OF THE INVENTION

The present disclosure provides a modular excavator, including a plurality of assembly modules that are detachably connected, the plurality of assembly modules including:

- a frame turntable base module;
- a track beam assembly module configured to be connected to the frame turntable base module;
- a track module configured to be connected to the track beam assembly module;
- a clewing drive module configured to be connected to the frame turntable base module;
- a power assembly module configured to be connected to the frame turntable base module;
- a counterweight module configured to be connected to the power assembly module;
- a cab module configured to be connected to the frame turntable base module;
- a fuel tank module configured to be connected to the frame turntable base module;
- a boom assembly module configured to be connected to the frame turntable base module;
- a bucket arm assembly module configured to be connected to the boom assembly module; and
- a work tool module configured to be connected to the bucket arm assembly module.

In the modular excavator of some embodiments, the weight of each assembly module is less than 2.8 tons.

In the modular excavator of some embodiments, at least two assembly modules are connected by a quick connection structure, the quick connection structure including:

- a guide positioning structure including two mutually cooperating guide elements that are provided on two assembly modules to be connected, respectively, the two guide elements being configured to guide the two assembly modules to be connected to reach and be positioned at an assembly position; and
- a locking structure configured to lock the two assembly modules at the assembly position.

In the modular excavator of some embodiments, the two mutually cooperating guide elements of the guide positioning structure include a guide positioning plate and a guide positioning pin shaft, the guide positioning plate having a guide opening and a positioning pin slot communicated with the guide opening, and the guide positioning pin shaft being configured to enter the positioning pin slot through the guide opening, and the guide positioning pin shaft cooperating with the positioning pin slot when the two assembly modules are in a connected state.

In the modular excavator of some embodiments,

- the guide positioning structure includes at least two sets of guide elements, two guide elements of each set of guide elements cooperating with each other; and
- the locking structure includes a limiting plate, which is configured to connect the two guide elements of the same set of guide elements to lock the relative positions of the two guide elements in at least one degree of freedom.

In the modular excavator of some embodiments, the guide positioning structure further includes two mutually cooperating positioning elements that are provided on the two assembly modules, respectively, namely a positioning plate and a cooperating plate, which, when the two assembly modules are in the connected state, abut against each other to position the two assembly modules at the assembly position.

In the modular excavator of some embodiments, the locking structure includes two locking portions, with self-locking pin holes, that are provided on the two assembly modules, respectively, and a self-locking pin shaft configured to cooperate with the two self-locking pin holes.

In the modular excavator of some embodiments, the two locking portions of the locking structure include a support plate and a pin shaft mounting plate, and the self-locking pin shaft cooperates with the two self-locking pin holes in the support plate and in the pin shaft mounting plate when the two assembly modules are in the connected state.

In the modular excavator of some embodiments,

- the track beam assembly module is connected to the frame turntable base module by the quick connection structure; and/or
- the power assembly module is connected to the frame turntable base module by the quick connection structure; and/or
- the cab module is connected to the frame turntable base module by the quick connection structure; and/or
- the fuel tank module is connected to the frame turntable base module by the quick connection structure.

In the modular excavator of some embodiments,

- at least two of the plurality of assembly modules include hydraulic lines, the hydraulic lines of the at least two assembly modules being connected by a quick connect plug; and/or at least two of the plurality of assembly modules include electrical lines, the electrical lines of the at least two assembly modules being connected by a quick connect plug.

In the modular excavator of some embodiments, the frame turntable base module includes a lower frame, a slew bearing assembly, a turntable main body, a central stewing body, a boom cylinder and a first hydraulic line, the slew bearing assembly, the turntable main body, the central slewing body, the boom cylinder and the first hydraulic line being mounted on the lower frame.

In the modular excavator of some embodiments, the modular excavator includes two track beam assembly modules connected to the left and right sides of the frame turntable base module respectively, and two track modules connected to the two track beam assembly modules, respectively.

In the modular excavator of some embodiments, the track beam assembly module includes a track longitudinal beam, a sprocket, an idler, a track roller, a carrier roller, a travel driving mechanism, and a second hydraulic line, the sprocket, the idler, the track roller, the carrier roller, the travel driving mechanism and the second hydraulic line are mounted on the track longitudinal beam, the track longitudinal beam being connected to the lower frame of the frame turntable base module by a quick connection structure.

In the modular excavator of some embodiments, the frame turntable base module includes a turntable main body, with a collar being provided on the turntable main body, the slewing, drive module being positioned to the collar by a positioning pin and connected thereto by a bolt.

In the modular excavator of some embodiments, the power assembly module includes an engine system, a hood, a first bottom bracket, a hydraulic tank, a hydraulic main valve, a main pump, and a third hydraulic line, the engine system, the hood, the hydraulic tank, the hydraulic main valve, the main pump and the third hydraulic line being mounted on the first bottom bracket, and the first bottom bracket being connected to the lower frame of the frame turntable base module by a quick connection structure.

In the modular excavator of some embodiments, the modular excavator includes at least two counterweight modules connected to the power assembly.

In the modular excavator of some embodiments, the power assembly module is positioned to at least one counterweight module by a positioning pin and connected thereto by a bolt.

In the modular excavator of some embodiments, the modular excavator includes two counterweight modules, the two counterweight modules including a lower counterweight module and an upper counterweight module, with guide posts being provided between connecting surfaces of the lower counterweight module and the upper counterweight module, the lower counterweight module and the upper counterweight module being locked by locking portions.

In the modular excavator of some embodiments, locking portion including:

a chain;

a hook provided on the lower counterweight module, a first end of the chain being hooked to the hook;

an adjustment plate locked to the upper counterweight module in a position adjustable manner with respect to the upper counterweight module, and having a through hole, a second end of the chain passing through the through hole; and a stopper removably fixed to a side of the adjustment plate away from the hook, and configured to partially cover the through hole to restrict part of links of the chain between the hook and the stopper.

In the modular excavator of some embodiments, the adjustment plate includes threaded holes, and the locking portion further includes locking screws cooperating with the threaded holes, the position of the adjustment plate relative to the upper counterweight module being adjusted and the adjustment plate being locked to the upper counterweight module, by means of the locking screws.

In the modular excavator of some embodiments, the cab module includes a cab and a second bottom bracket supporting the cab, the second bottom bracket being connected to a turntable main body of the frame turntable base module by the quick connection structure.

In the modular excavator of some embodiments, the fuel tank module includes a fuel tank and a third bottom bracket supporting the fuel tank, the third bottom bracket being connected to a turntable main body of the frame turntable base module by the quick connection structure.

In the modular excavator of some embodiments, the boom assembly module includes a boom main body, a bucket arm cylinder and a fourth hydraulic line, the bucket arm cylinder and the fourth hydraulic line being mounted on the boom main body, and a rear end of the boom main body being positioned by means of a positioning structure and hinged by means of a pin shaft to a front end of a turntable main body of the frame turntable base module.

In the modular excavator of some embodiments, the bucket arm assembly module includes a bucket arm main body, a bucket cylinder, a first quick-change device coupling portion, and a fifth hydraulic line, the bucket cylinder, the first quick-change device coupling portion and the fifth hydraulic line being mounted on the bucket arm main body, and a rear end of the bucket arm main body being positioned by means of a positioning structure and hinged by means of a pin shaft to a front end of the boom main body; and the work tool module includes a tool body and a second quick-change device coupling portion provided on the tool body, a front end of the bucket arm main body being connected to the work tool module by the first quick-change device coupling portion and the second quick-change device coupling portion.

In the modular excavator of some embodiments, the first quick-change device coupling portion includes a first coupling body, locking pin shafts, a quick-change cylinder, a pin shaft hook plate, and bucket arm connecting pin shafts, the locking pin shafts, the quick-change cylinder and the pin shaft hook plate being provided on the first coupling body, the quick-change cylinder being drivingly connected to the locking pin shafts to drive the locking pin shafts to move relative to the first coupling body, and the first coupling body being hinged to the bucket arm main body and the bucket cylinder by means of the two bucket arm connecting pin shafts, respectively; and the second quick-change device coupling portion includes a second coupling body, locking bushings, a coupling body connecting pin shaft, and work tool connecting pin shafts, the locking bushings and the coupling body connecting pin shaft being provided on the second coupling body, and the second coupling body being connected to the work tool body by means of the two work tool connecting pin shafts, wherein the first quick-change device coupling portion is connected to the second quick-change device coupling portion by hooked cooperation between the pin shaft hook plate and the coupling body connecting pin shaft and by plug-in cooperation between the locking pin shafts and the locking bushings.

Based on the modular excavator provided in the present disclosure, the excavator is reasonably divided into a plurality of assembly modules, which is conducive to controlling the weights of the assembly modules, and is favorable for a transfer device to transport the assembly modules of the modular excavator to a designated location within its carrying range, and for improving the safety of transport of the assembly modules, and reducing restrictions on means of transport, which is favorable for rapid arrival at a working site, thereby facilitating the guarantee of the working progress, such as facilitating rapid arrival at an emergency rescue site, to implement rescue and relief work as soon as possible.

Other features and advantages of the present disclosure will become apparent from the following detailed description of exemplary embodiments of the present disclosure with reference to the accompanying drawings.

BRIEF DESCRIPTION OF THE DRAWINGS

Drawings described here are used to provide further understanding of the present disclosure and form a part of the present application. Illustrative embodiments of the present disclosure and description thereof are used for explaining the present disclosure, but do not improperly limit the present disclosure. In the drawings.

DETAILED DESCRIPTION OF THE EMBODIMENTS

Figure 1:
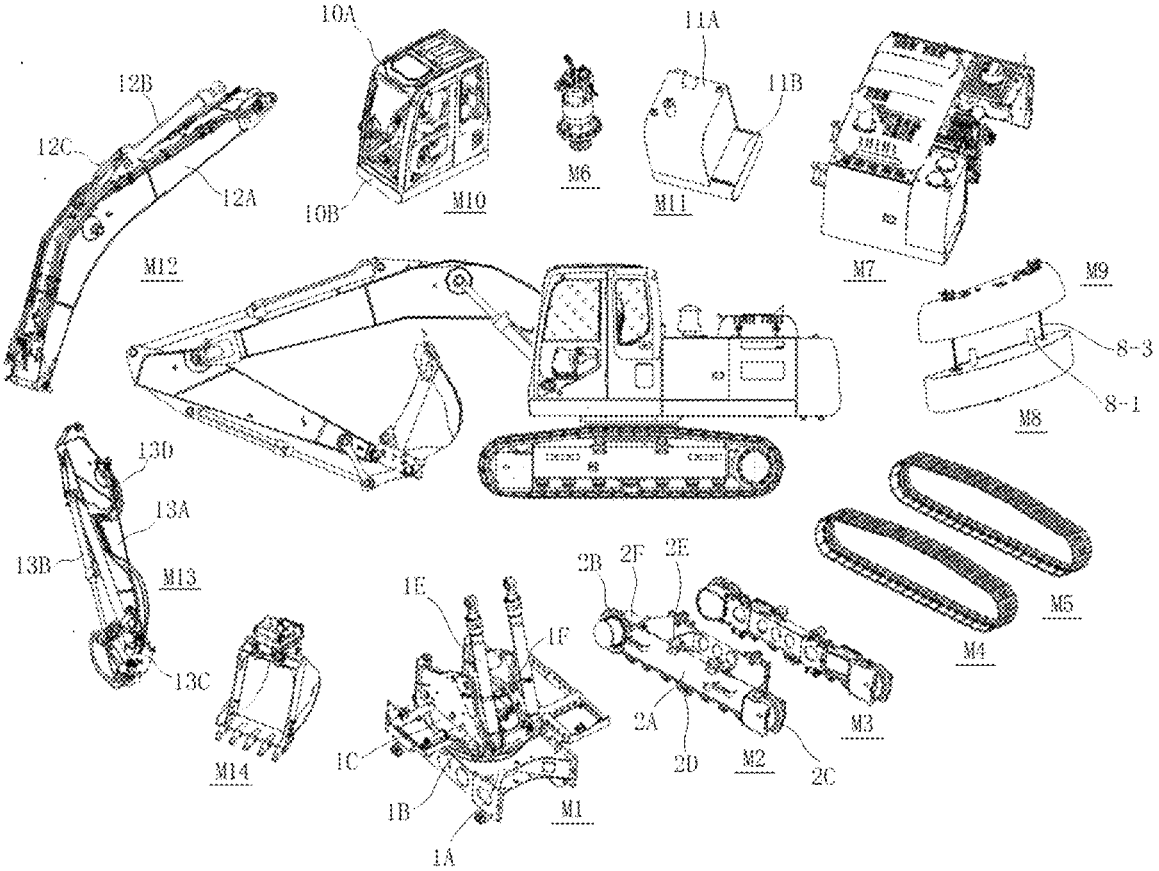
FIG. 1 is a structure diagram of a modular excavator of an embodiment of the present disclosure and assembly modules thereof.

Technical solutions in the embodiments will be described below clearly and completely in conjunction with the accompanying drawings in the embodiments of the present disclosure. Obviously, the described embodiments are only a part of the embodiments of the present application, and not all the embodiments. The following description of at least one exemplary embodiment is actually only illustrative, and in no way serves as any limitation on the present disclosure and its application or use. Based on the embodiments in the present disclosure, all of other embodiments obtained by a person of ordinary skill in the art without creative work should fall into the protection scope of the present disclosure.

Unless specifically stated otherwise, the relative arrangement of components and steps, numerical expressions and numerical values set forth in these embodiments do not limit the scope of the present disclosure. Furthermore, it should be appreciated that, for ease of description, the sizes of various parts shown in the drawings are not drawn in accordance with actual proportional relationships. Technologies, methods, and devices known to those of ordinary skill in the related art may be not discussed in detail, but where appropriate, the technologies, methods, and device should be regarded as part of the specification as granted. In all examples shown and discussed here, any specific value should be interpreted as merely exemplary, rather than as a limitation. Therefore, other examples of an exemplary embodiment may have different values. It should be noted that similar reference numerals and letters denote similar items in the following drawings, so once a certain item is defined in one drawing, it does not need to be further discussed in subsequent drawings.

In the description of the present disclosure, it should be understood that the use of terms such as "first" and "second" to define parts and components is only for the convenience of distinguishing the corresponding parts and components. Unless otherwise stated, the above terms have no special meanings, and therefore cannot be construed as limitations on the protection scope of the present disclosure.

In description of the present disclosure, it should be understood that orientation or position relations denoted by terms such as "front", "rear". "upper". "lower", "left", "right", "transverse" "longitudinal", "vertical", "horizontal" "top" and "bottom" are generally orientation or position relations illustrated based on the drawings, and are merely for the convenience of describing the present disclosure and simplifying description, and unless stated to the contrary, such terms do not indicate or imply the denoted devices or elements must have specific orientations or be constructed and operated in specific orientations, and thus cannot be construed as limiting the protection scope of the present disclosure; and orientation terms "inner" and "outer" refer to the inside and outside with respect to the contour of each component itself.

In the following description, the so-called "front" refers to the front of a modular excavator, "rear" refers to a side opposite to the "front", and "left" and "right" refer to left and right directions formed when facing the front.

As shown in FIGS. 1 to 16, the present disclosure provides a modular excavator, which includes a plurality of assembly modules that are detachably connected.

The plurality of assembly modules include: a frame turntable base module M1; a track beam assembly module configured to be connected to the frame turntable base module M1; a track module configured to be connected to the track beam assembly module; a clewing drive module M6 configured to be connected to the frame turntable base module M1; a power assembly module M7 configured to be connected to the frame turntable base module M1; a counterweight module configured to be connected to the power assembly module M7; a cab module M10 configured to be connected to the frame turntable base module M1; a fuel tank module M11 configured to be connected to the frame turntable base module M1; a boom assembly module M12 configured to be connected to frame turntable base module M1; a bucket arm assembly module M13 configured to be connected to the boom assembly module M12; and a work tool module M14 configured to be connected to the bucket arm assembly module M13.

In the modular excavator of embodiments of the present disclosure, the excavator is reasonably divided into a plurality of assembly modules, which is conducive to controlling the weights of the assembly modules, and is favorable for a transfer device to transport the assembly modules of the modular excavator to a designated location within its carrying range, and for improving the safety of transport of the assembly modules, and reducing restrictions on means of transport, such as being more suitable for safe transport by transport planes, which is favorable for rapid arrival at a working site, thereby facilitating the guarantee of the working progress, such as facilitating rapid arrival at an emergency rescue site, to implement rescue and relief work as soon as possible.

In the modular excavator of some embodiments, the weight of each assembly module is less than 2.8 tons. By reasonably setting the weight of each assembly module, the weight of each assembly module is limited to a certain range, which is more favorable for a transfer device to transport the assembly modules of the modular excavator to a designated location within its carrying range, and for improving the safety of transport of the assembly modules, reducing restrictions on means of transport, and reducing the possibility of delaying the transport of the modular excavator to the designated location due to the absence of suitable means of transport.

In the modular excavator of some embodiments, at least two assembly modules are connected by a quick connection structure, which includes a guide positioning structure and a locking structure. The guide positioning structure includes two mutually cooperating guide elements that are provided on two assembly modules to be connected, respectively. The two guide elements are configured to guide the two assembly modules to be connected to reach and be positioned at an assembly position. The locking structure is configured to lock the two assembly modules at the assembly position. By providing the quick connection structure with the guide structure and the locking structure, the two assembly modules can quickly reach the assembly position and be locked by a guide positioning step and a locking step, thus being conducive to improving an assembly speed of the two assembly modules.

In the modular excavator of some embodiments, the two mutually cooperating guide elements of the guide positioning structure include a guide positioning plate and a guide positioning pin shaft. The guide positioning plate has a guide opening and a positioning pin slot communicated with the guide opening, and the guide positioning pin shaft is configured to enter the positioning pin slot through the guide opening. The guide positioning pin shaft cooperates with the positioning pin slot when the two assembly modules are in a connected state. This configuration is favorable for the guide positioning pin to enter the positioning pin slot along a side wall of the guide opening after being placed inside the guide opening, thus facilitating the two assembly modules reaching the assembly position quickly.

In the modular excavator of some embodiments, the guide positioning structure includes at least two sets of guide elements, two guide elements of each set of guide elements cooperating with each other; and the locking structure includes a limiting plate, which is configured to connect the two guide elements of the same set of guide elements to lock the relative positions of the two guide elements in at least one degree of freedom. By locking the relative positions of the two guide elements, in conjunction with the positioning function of the at least two sets of guide elements, the locking of the two assembly modules at the assembly position can be achieved at least partially, to facilitate quick connection of the two assembly modules.

In the modular excavator of some embodiments, the guide positioning structure further includes two mutually cooperating positioning elements that are provided on the two assembly modules, respectively, namely a positioning plate and a cooperating plate, which, when the two assembly modules are in the connected state, abut against each other to position the two assembly modules at the assembly position. Providing the two positioning elements is conducive for further determining the assembly position of the two assembly modules quickly and accurately, to facilitate quick connection of the two assembly modules.

In the modular excavator of some embodiments, the locking structure includes two locking portions, with self-locking pin holes, that are provided on the two assembly modules, respectively, and a self-locking pin shaft configured to cooperate with the two self-locking pin holes. The cooperation between the locking portions and the self-locking pin shaft facilitates quick connection of the two assembly modules after positioning.

In the modular excavator of some embodiments, the two locking portions of the locking structure include a support plate and a pin shaft mounting plate. The self-locking pin shaft cooperates with the two self-locking pin holes in the support plate and in the pin shaft mounting plate when the two assembly modules are in the connected state.

In the modular excavator of some embodiments, the track beam assembly module is connected to the frame turntable base module M1 by the quick connection structure; and/or the power assembly module M7 is connected to the frame turntable base module M1 by the quick connection structure; and/or the cab module M10 is connected to the frame turntable base module M1 by the quick connection structure; and/or the fuel tank module M11 is connected to the frame turntable base module M1 by the quick connection structure. This configuration facilitates quick positioning and quick connection of the track beam assembly module and/or the power assembly module M7 and/or the cab module M10 and/or the fuel tank module M11 to the frame turntable base module M1, which is conducive to improving the assembly efficiency of the whole machine.

In the modular excavator of some embodiments, at least two of the plurality of assembly modules include hydraulic lines, the hydraulic lines of the at least two assembly modules being connected by a quick connect plug; and/or at least two of the plurality of assembly modules include electrical lines, the electrical lines of the at least two assembly modules being connected by a quick connect plug.

In the modular excavator of some embodiments, the modular excavator includes two track beam assembly modules M2 and M3 connected to the left and right sides of the frame turntable base module M1, respectively, and two track modules M4 and M5 connected to the two track beam assembly modules M2 and M3, respectively. The modular excavator including two track beam assembly modules and two track modules is conducive to reducing the weight of each track beam assembly module and each track module, thus facilitating safe and timely transport of the two track beam assembly modules and the two track modules. The two track beam assembly modules are, for example, a left track beam assembly module M2 and a right track beam assembly module M3, and the two track modules are, for example, a left track module M4 and a right track module M5.

A modular excavator of an embodiment of the present disclosure will be described in more detail below in conjunction with FIGS. 1 to 16.

The modular excavator includes a plurality of assembly modules that are detachably connected. The plurality of assembly modules include a frame turntable base module M1, a total of two track beam assembly modules including a left track beam assembly module M2 and a right track beam assembly module M3, a total of two track modules including a left track module M4 and a right track module M5, a slewing drive module M6, a power assembly module M7, a total of two counterweight modules including a lower counterweight module M8 and an upper counterweight module M9, a cab module M10, a fuel tank module M11, a boom assembly module M12, a bucket arm assembly module M13, and a work tool module M14.

As shown in FIG. 1, in the modular excavator of some embodiments, the frame turntable base module M1 includes a lower frame 1A, a slew bearing assembly 1B, a turntable main body 1C, a central slewing body 1D, a boom cylinder 1E, and a first hydraulic line 1F. The slew bearing assembly 1B, the turntable main body 1C, the central slewing body 1D, the boom cylinder if and the first hydraulic line 1F are mounted on the lower frame 1A. The slew bearing assembly 1B includes a fixed part and a rotating part rotatable relative to the fixed part. The fixed part is mounted on the lower frame 1A, and the turntable main body 1C is mounted on the rotating part, such that the turntable main body 1C is rotatable relative to the lower frame 1A about a rotation axis in an up-down direction. The central slewing body 1D connects a fixed line part of the first hydraulic line 1F fixed relative to the lower frame 1A and a movable line part fixed relative to the turntable main body 1C. By adopting the central slewing body 1D, the fixed line part and the movable line part are relatively movable while satisfying a required connection relationship.

As shown in FIG. 1, in the modular excavator of some embodiments, the left track beam assembly module M2 includes a track longitudinal beam 2A, a sprocket 2B, an idler 2C, a track roller 2D, a carrier roller 2E, a travel driving mechanism 2F, and a second hydraulic line 2H. The sprocket 2B, the idler 2C, the track roller 2D, the carrier roller 2E, the travel driving mechanism 2F and the second hydraulic line 2H are mounted on the track longitudinal beam 2A. The track longitudinal beam 2A is connected to the lower frame 1A of the frame turntable base module M1 by a quick connection structure. Thus, just by quickly connecting the track longitudinal beam 2A and the lower frame 1A, a mechanical connection between the left track beam assembly module M2 and the frame turntable base module M1 can be achieved, which is conducive to increasing the speed of assembling the same. The structure of the right track beam assembly module M3 and the mode of connecting the same to the frame turntable base module M1 are same as the structure of the left track beam assembly module M2 and the mode of connecting the same to the frame turntable base module, and will not be described repeatedly.

As shown in FIG. 1, in the modular excavator of some embodiments, the frame turntable base module M1 includes a turntable main body 1C, with a collar 1-7 being provided on the turntable main body 1C, the slewing drive module M6 being positioned to the collar 1-7 by a positioning pin and connected thereto by a bolt. This configuration is conducive to quick assembly of the slewing drive module M6 and the frame turntable base module M1. The slewing drive module M6 is configured to drive the turntable main body 1C to rotate relative to the lower frame 1A, thereby causing the assembly modules mounted on the turntable main body 1C to rotate relative to the lower frame 1A and the assembly modules mounted on the lower frame 1A.

Figure 8:
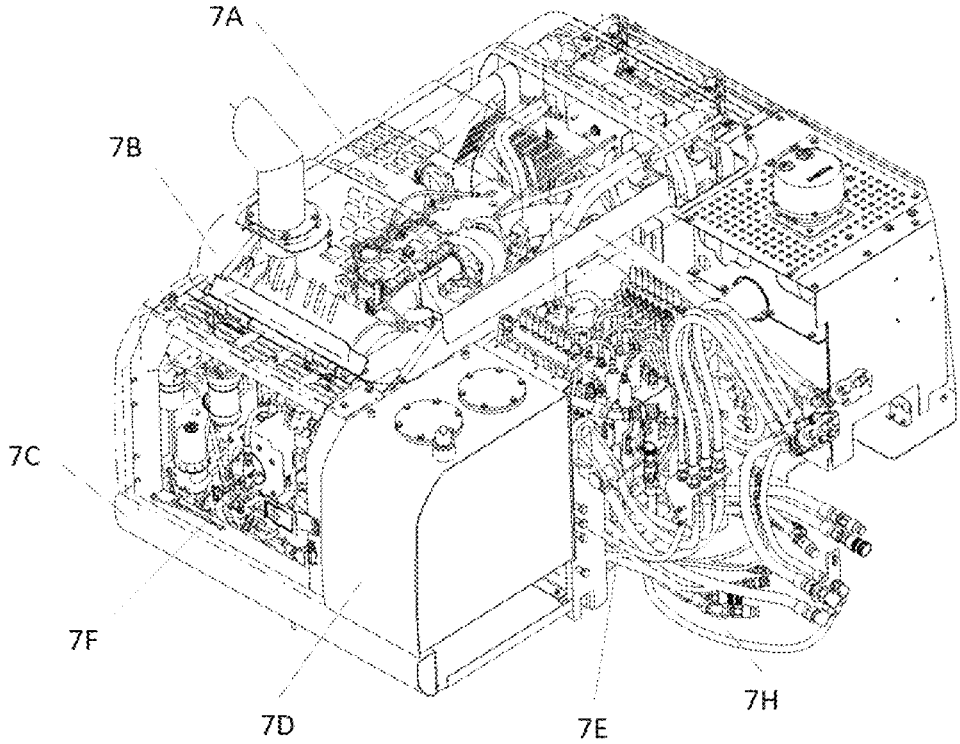
FIG. 8 is a structure diagram of a power assembly module of the modular excavator of the embodiment of the present disclosure.
Figure 9:
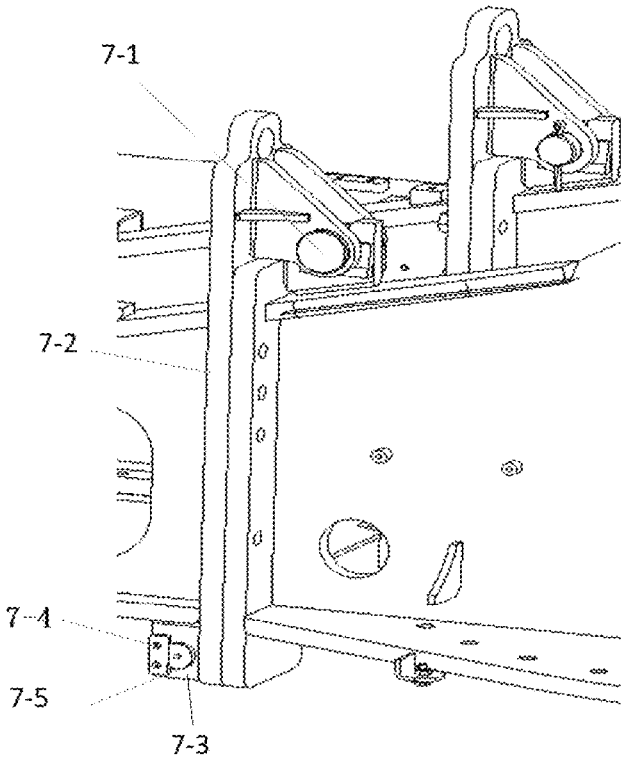
FIG. 9 is a partial structure diagram of a first bottom bracket of the power assembly module of the modular excavator of the embodiment of the present disclosure.

As shown in FIGS. 1, 8 and 9, in the modular excavator of some embodiments, the power assembly module M7 includes an engine system 7A, a hood 7B, a first bottom bracket 7C, a hydraulic tank 7D, a hydraulic main valve 7E, a main pump 7F, and a third hydraulic line 7H. The engine system 7A, the hood 7B, the hydraulic tank 7D, the hydraulic main valve 7E, the main pump 7F and the third hydraulic line 711 are mounted on the first bottom bracket 7C, and the first bottom bracket 7C is connected to the lower frame 1A of the frame turntable base module M1 by a quick connection structure. Thus, just by quickly connecting the first bottom bracket 7C and the lower frame 1A, a mechanical connection between the power assembly module M7 and the frame turntable base module M1 can be achieved, which is conducive to increasing the speed of assembling the same.

As shown in FIG. 1, in the modular excavator of some embodiments, the modular excavator includes at least two counterweight modules M8, M9 connected to the power assembly module M7. Providing the at least two counterweight modules is conducive to reducing the weight of each counterweight module, thereby facilitating the transport of the counterweight modules. The two counterweight modules include, for example, a lower counterweight module M8 and an upper counterweight module M9 located above the lower counterweight module.

As shown in FIG. 1, in the modular excavator of some embodiments, the power assembly module M7 is positioned to at least one counterweight module M8 by a positioning pin and connected thereto by a bolt. This configuration is conducive to quick assembly of the counterweight module and the power assembly module.

Figure 10:
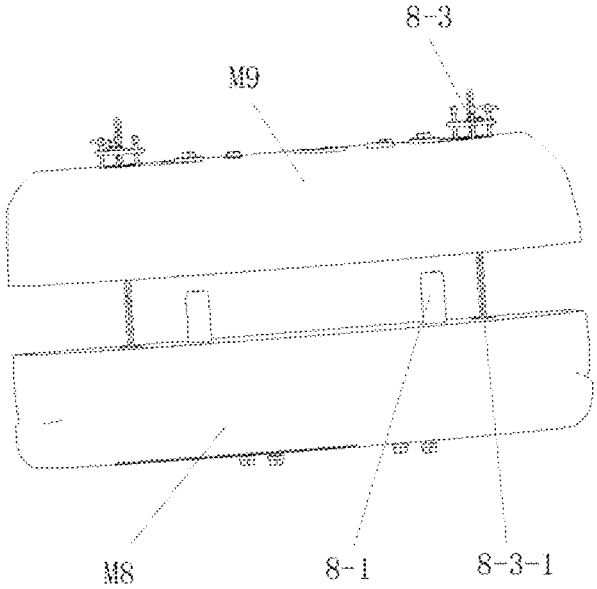
FIG. 10 is a structural diagram of two counterweight modules of the embodiment of the present disclosure during assembly.
Figure 11:
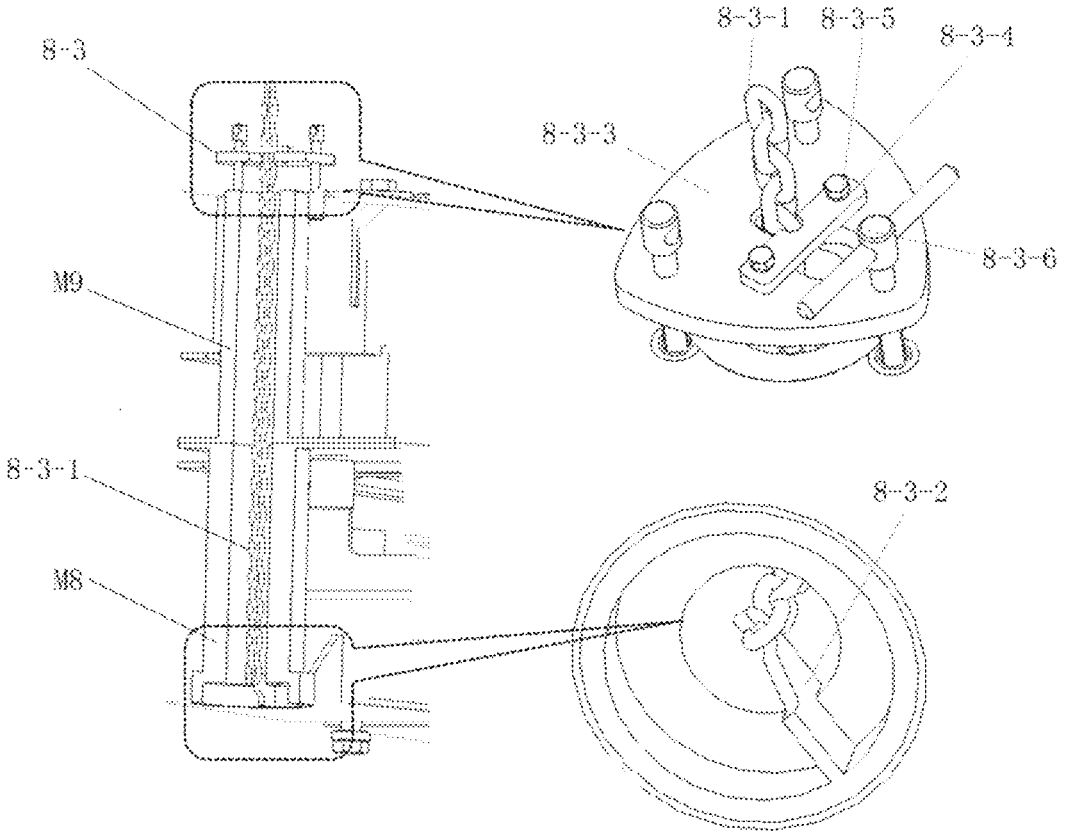
FIG. 11 is a partial structure diagram of the two counterweight modules of the embodiment of the present disclosure after assembled with each other.

As shown in FIGS. 1, 10 and 11, in the modular excavator of some embodiments, the modular excavator includes two counterweight modules M8 and M9. The two counterweight modules M8 and M9 include a lower counterweight module M8 and an upper counterweight module M9, with guide posts 8-1 being provided between connecting surfaces of the lower counterweight module M8 and the upper counterweight module M9, and the lower counterweight module M8 and the upper counterweight module M9 being locked by locking portions 8-3.

As shown in FIGS. 10 and 11, in the modular excavator of some embodiments, the locking portion 8-3 includes a chain 8-3-1, a hook 8-3-2, an adjustment plate 8-3-3, and a stopper 8-3-4. The hook 8-3-2 is provided on the lower counterweight module M8, and a first end of the chain 8-3-1 is hooked to the hook 8-3-2. The adjustment plate 8-3-3 is locked to the upper counterweight module M9 in a position adjustable manner with respect to the upper counterweight module M9. The adjustment plate 8-3-3 has a through hole 8-3-3A. A second end of the chain 8-3-1 passes through the through hole 8-3-3A. The stopper 8-3-4 is removably fixed to a side of the adjustment plate 8-3-3 away from the hook 8-3-2, and is configured to partially cover the through hole 8-3-3A to restrict part of links of the chain 8-3-1 between the hook 8-3-2 and the stopper 8-3-4.

As shown in FIGS. 10 and 11, in the modular excavator of some embodiments, the adjustment plate 8-3-3 includes threaded holes, and the locking portion 8-3 further includes locking screws 8-3-6 cooperating with the threaded holes. The position of the adjustment plate 8-3-3 relative to the upper counterweight module M9 is adjusted and the adjustment plate is locked to the upper counterweight module M9, by means of the locking screws 8-3-6.

As shown in FIGS. 10 and 11, the locking screws 8-3-6 is, for example, a bolt, and the upper counterweight module M9 falls onto the lower counterweight module M8 by means of a guiding and positioning function of the guide posts 8-1. The chain 8-3-1 passes through the upper counterweight module M9 and the lower counterweight module M8 from top to bottom, with a lower end of the chain 8-3-1 being hooked to the hook 8-3-2 fixed at the bottom of the lower counterweight module M8, and an upper end of the chain 8-3-1 being locked and fixed to the upper counterweight module M9. When the upper end of the chain 8-3-1 is locked and fixed to the upper counterweight module M9, the plate-like stopper 8-3-4 is removably fixed to the adjustment plate 8-3-3 by bolts 8-3-5, and a link of the chain 8-3-1 located in the through hole 8-3-3A is clamped by means of the adjustment plate 8-3-3 and the stopper 8-3-4 to restrict the chain from movement. The stopper 8-3-4 can be provided with a groove, and the link abuts against the groove to be conducive to preventing wear of the clamped link. The adjustment plate 8-3-3 and the locking screws 8-3-6 are in threaded connection. Turning a number of locking screws 8-3-6 respectively causes the adjustment plate 8-3-3 to move upward, which in turn causes the chain 8-3-1 to be pulled tight and locked.

The mode of connecting different counterweight modules by the locking portions 8-3 described above avoids the use of oversized bolts, reduces assembly tools, and reduces the intensity of field assembly work.

As shown in FIG. 1, in the modular excavator of some embodiments, the cab module M10 includes a cab 10A and a second bottom bracket 10B supporting the cab 10A. The second bottom bracket 10B is connected to the turntable main body 1C of the frame turntable base module M1 by the quick connection structure. Thus, just by quickly connecting the second bottom bracket 10B and the lower frame 1A, a mechanical connection between the cab module M10 and the frame turntable base module M1 can be achieved, which is conducive to increasing the speed of assembling the same.

As shown in FIG. 1, in the modular excavator of some embodiments, the fuel tank module M11 includes a fuel tank 11A and a third bottom bracket 11B supporting the fuel tank 11A. The third bottom bracket 11B is connected to the turntable main body 1C of the frame turntable base module M1 by the quick connection structure. Thus, just by quickly connecting the third bottom bracket 11B and the lower frame 1A, a mechanical connection between the fuel tank module M11 and the frame turntable base module M1 can be achieved, which is conducive to increasing the speed of assembling the same.

As shown in FIG. 1, in the modular excavator of some embodiments, the boom assembly module M12 includes a boom main body 12A, a bucket arm cylinder 12B and a fourth hydraulic line 12C. The bucket arm cylinder 12B and the fourth hydraulic line 12C are mounted on the boom main body 12A, and a rear end of the boom main body 12A is positioned by means of a positioning structure and hinged by means of a pin shaft to a front end of the turntable main body 1C of the frame turntable base module M1. This configuration can achieve quick connection of the boom assembly module M12 and the turntable main body 1C.

Figure 15:
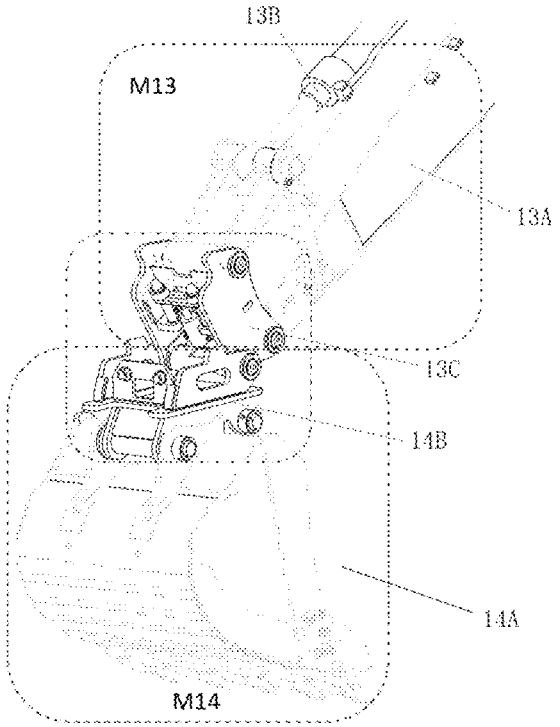
FIG. 15 is a structure diagram of a bucket arm assembly module and the boom assembly module of the modular excavator of the embodiment of the present disclosure during assembly.
Figure 16:
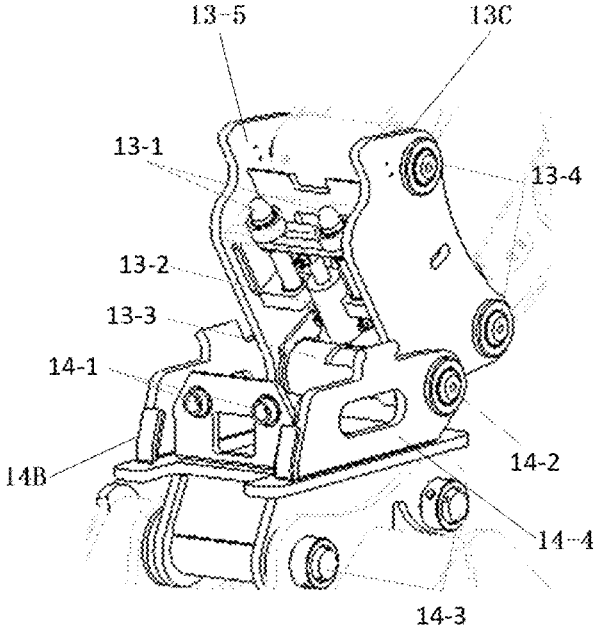
FIG. 16 is a partial structure diagram of FIG. 15.

As shown in FIGS. 1, 15 and 16, in the modular excavator of some embodiments, the bucket arm assembly module M13 includes a bucket arm main body 13A, a bucket cylinder 13B, a first quick-change device coupling portion 13C, and a fifth hydraulic line 13D. The bucket cylinder 13B, the first quick-change device coupling portion 13C and the fifth hydraulic line 13D are mounted on the bucket arm main body 13A. A rear end of the bucket arm main body 13A is positioned by means of a positioning structure and hinged by means of a pin shaft to a front end of the boom main body 12A. The work tool module M14 includes a tool body 14A and a second quick-change device coupling portion 14B provided on the tool body 14A. A front end of the bucket arm main body 13A is connected to the work tool module 1\414 by the first quick-change device coupling portion 13C and the second quick-change device coupling portion 14B. The tool body 14A of the work tool module M14 includes, for example, a bucket. This configuration is conducive to quick assembly of the work tool module M14 and the bucket arm assembly module M13.

As shown in FIGS. 15 and 16, in some embodiments, the first quick-change device coupling portion 13C includes a first coupling body 13-5, locking pin shafts 13-1, a quick-change cylinder 13-2, a pin shaft hook plate 13-3, and bucket arm connecting pin shafts 13-4. The locking pin shafts 13-1, the quick-change cylinder 13-2 and the pin shaft hook plate 13-3 are provided on the first coupling body 13-5. The quick-change cylinder 13-2 is drivingly connected to the locking pin shafts 13-1 to drive the locking pin shafts 13-1 to move relative to the first coupling body 13-5. The first coupling body 13-5 is hinged to the bucket arm main body 13A and the bucket cylinder 13B by means of the two bucket arm connecting pin shafts 13-4, respectively. The second quick-change device coupling portion 14B includes a second coupling body 14-4, locking bushings 14-1, a coupling body connecting pin shaft 14-2, and work tool connecting pin shafts 14-3. The locking bushings 14-1 and the coupling body connecting pin shaft 14-2 are provided on the second coupling body 14-4. The second coupling body 14-4 is connected to the work tool body 14A by means of the two work tool connecting pin shafts 14-3.

The first quick-change device coupling portion 13C is connected to the second quick-change device coupling portion 14B by hooked cooperation between the pin shaft hook plate 13-3 and the coupling body connecting pin shaft 14-2 and by plug-in cooperation between the locking pin shafts 13-1 and the locking bushings 14-1.

As shown in FIGS. 15 and 16, to assemble the bucket arm assembly module M13 with the work tool module M14, the pin shaft hook plate 13-3 is hooked to the coupling body connecting pin shaft 14-2, and the quick-change cylinder 13-2 is contracted so that the locking pin shafts 13-1 retract, and the bucket cylinder 13B is extended so that the first quick-change device coupling portion 13C and the second quick-change device coupling portion 14B rotate counter-clockwise around the coupling body connecting pin shaft 14-2; and after the locking pin shafts 13-1 fall to be coaxial with the centers of the locking bushings 14-1, the quick-change cylinder 13-2 is extended so that the locking pin shafts 13-1 are plugged into the locking bushings 14-1, to accomplish locking connection of the first coupling body 13-5 and the second coupling body 14-4, thereby accomplishing connection of the first quick-change device coupling portion 13C and the second quick-change device coupling portion 14B, thus achieving the assembly of the bucket arm assembly module M13 and the work tool module M14.

The quick connection structure of one of embodiments of the present disclosure will be described below by describing a first quick connection structure that connects the track longitudinal beam 2A of the left track beam assembly module M2 to the lower frame 1A of the frame turntable base module M1 as an example. A quick connection structure that connects the track longitudinal beam of the right track beam assembly module to the lower frame 1A is same as the first quick connection structure, and will not be described repeatedly.

Figure 4:
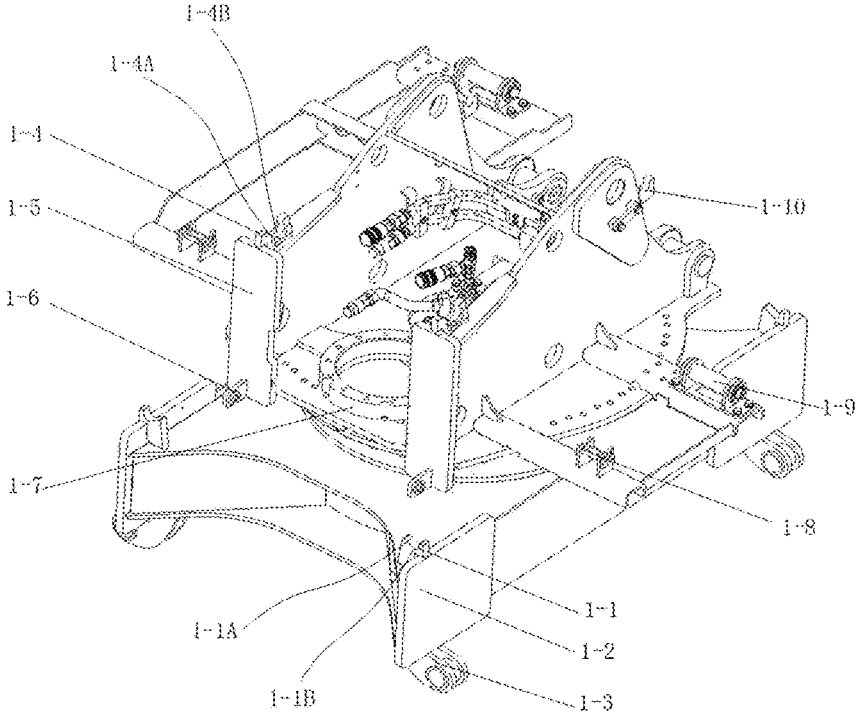
FIG. 4 is a structure diagram of a frame turntable base module of the modular excavator of the embodiment of the present disclosure.
Figure 5:
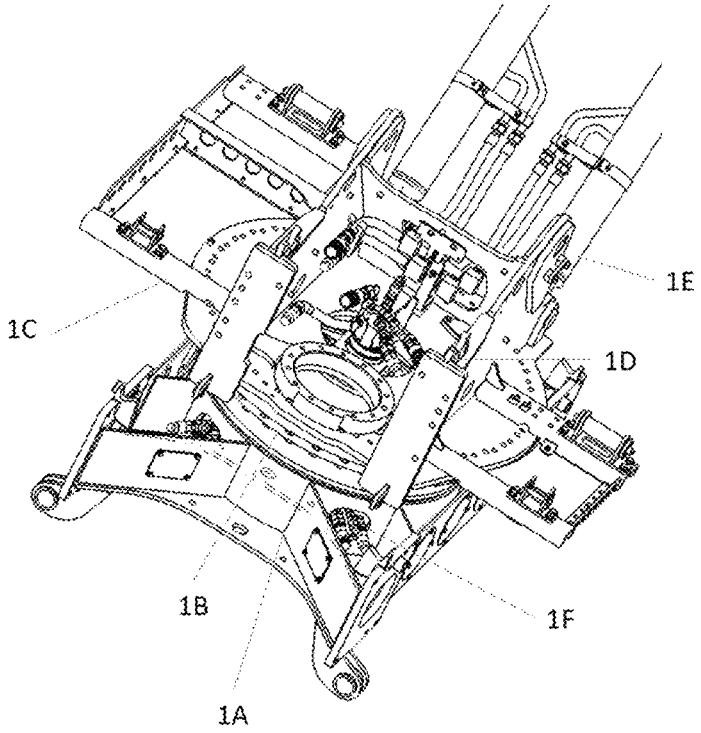
FIG. 5 is a structure diagram of the frame turntable base module of the modular excavator of the embodiment of the present disclosure.
Figure 6:
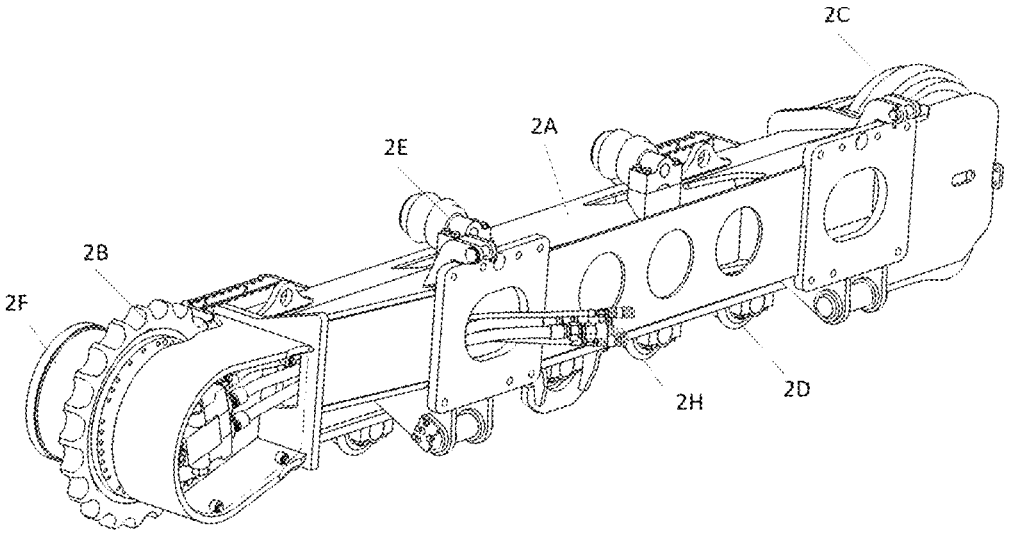
FIG. 6 is a structure diagram of a track beam assembly module of the modular excavator of the embodiment of the present disclosure.
Figure 7:
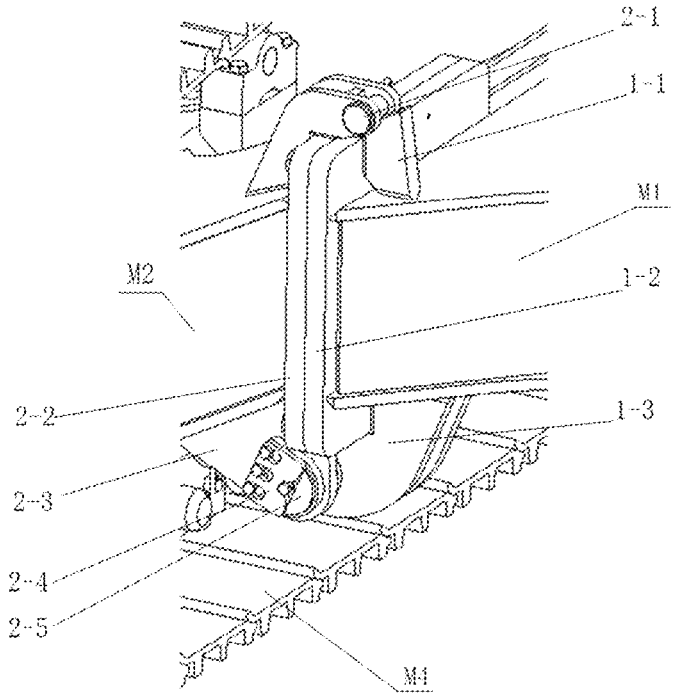
FIG. 7 is a partial structure diagram of a lower frame of the frame turntable base module and a track longitudinal beam of the track beam assembly module, of the modular excavator of the embodiment of the present disclosure, after assembled with each other.

As shown in FIGS. 4 and 7, the first quick connection structure includes a guide positioning structure and a locking structure. In the first quick connection structure, the guide positioning structure includes a first guide positioning plate 1-1, a first guide positioning pin shaft 2-1, a first positioning plate 1-2, and a first cooperating plate 2-2. The first guide positioning plate 1-1 and the first guide positioning pin shaft 2-1 are two mutually cooperating guide elements of the guide positioning structure of the first quick connection structure, and the first positioning plate 1-2 and the first cooperating plate 2-2 are two mutually cooperating positioning elements of the guide positioning structure of the first quick connection structure. In the first quick connection structure, the locking structure includes a first support plate 1-3, a first pin shaft mounting plate 2-3, and a first locking pin shaft 2-5. The first support plate 1-3 and the first pin shaft mounting plate 2-3 are two locking portions, with self-locking pin holes, of the locking structure.

The first guide positioning plate 1-1, the first positioning plate 1-2 and the first support plate 1-3 are arranged on a lateral side of the lower frame 1A. The first guide positioning plate 1-1 has a first guide opening 1-1A located above and a first positioning pin slot 1-1B located at the bottom of the first guide opening 1-1A and communicated with the first guide opening 1-1A. The first support plate 1-3 is located below the first guide positioning plate 1-1. The first support plate 1-3 is provided with a first locking pin hole parallel to the axis of the first positioning pin slot 1-1B. The first positioning plate 1-2 is located between the first guide positioning plate 1-1 and the first support plate 1-3.

The first guide positioning pin shaft 2-1, the first cooperating plate 2-2 and the first pin shaft mounting plate 2-3 are arranged on a lateral side of the track longitudinal beam 2A. The first guide positioning pin shaft 2-1 is configured to enter the first positioning pin slot 1-1B through the first guide opening 1-1A. The first pin shaft mounting plate 2-3 is located below the first guide positioning pin shaft 2-1, and configured to have a second locking pin hole parallel to the axis of the first guide positioning pin shaft 2-1. The first cooperating plate 2-2 is located between the first guide positioning pin shaft 2-1 and the first pin shaft mounting plate 2-3. When the frame turntable base module M1 and the track beam assembly module M2, M3 are in the connected state, the first guide positioning pin shaft 2-1 cooperates with the first positioning pin slot 1-1B, the first cooperating plate 2-2 abuts against the first positioning plate 1-2, the first locking pin hole and the second locking pin hole are coaxial, and the first locking pin shaft 2-5 cooperates with the first locking pin hole and the second locking pin hole.

The first bottom bracket 7C of the power assembly module M7 is connected to the lower frame 1A of the frame turntable base module M1 by a second quick connection structure, which is similar to the first quick connection structure.

As shown in FIGS. 4, 7 and 9, the second quick connection structure includes a guide positioning structure and a locking structure. In the second quick connection structure, the guide positioning structure includes a second guide positioning plate 1-4, a second guide positioning pin shaft 7-1, a second positioning plate 1-5, and a second cooperating plate 7-2. The second guide positioning plate 1-4 and the second guide positioning pin 7-1 are two mutually cooperating guide elements of the guide positioning structure of the second quick connection structure, and the second positioning plate 7-2 and the first cooperating plate 2-2 are two mutually cooperating positioning elements of the guide positioning structure of the second quick connection structure. In the second quick connection structure, the locking structure includes a second support plate 1-6, a second pin shaft mounting plate 7-3, and a second locking pin shaft 7-5. The second support plate 7-3 and the second pin shaft mounting plate 2-3 are two locking portions, with self-locking pin holes, of the locking structure.

The second guide positioning plate 1-4, the cooperating plate 1-5 and the second support plate 1-6 are arranged at an upper part of a rear side of the lower frame 1A. The second guide positioning plate 1-4 has a second guide opening 1-4A located above and a second positioning pin slot 1-4B located at the bottom of the second guide opening 1-4A and communicated with the second guide opening 1-4A. The second support plate 1-6 is located below the second guide positioning plate 1-4, and the second support plate 1-6 is provided with a third locking pin hole parallel to the axis of the second positioning pin slot 1-4B. The cooperating plate 1-5 is located between the second guide positioning plate 1-4 and the second support plate 1-6.

The second guide positioning pin shaft 7-1, the second cooperating plate 7-2 and the second pin shaft mounting plate 7-3 are arranged on a lateral side of the first bottom bracket 7C of the power assembly module M7. The second guide positioning pin shaft 7-1 is configured to enter the second positioning pin slot 1-4B through the second guide opening 1-4A. The second pin shaft mounting plate 7-3 is located below the second guide positioning pin shaft 7-1, and configured to have a fourth locking pin hole parallel to the axis of the second guide positioning pin shaft 7-1. The second cooperating plate 7-2 is located between the second guide positioning pin shaft 7-1 and the second pin shaft mounting plate 7-3. When the frame turntable base module M1 and the power assembly module M7 are in the connected state, the second guide positioning pin shaft 7-1 cooperates with the second positioning pin slot 1-4B, the second cooperating plate 7-2 abuts against the cooperating plate 1-5, the third locking pin hole and the fourth locking pin hole are coaxial, and the second locking pin shaft 7-5 cooperates with the third locking pin hole and the fourth locking pin hole.

Figure 2:
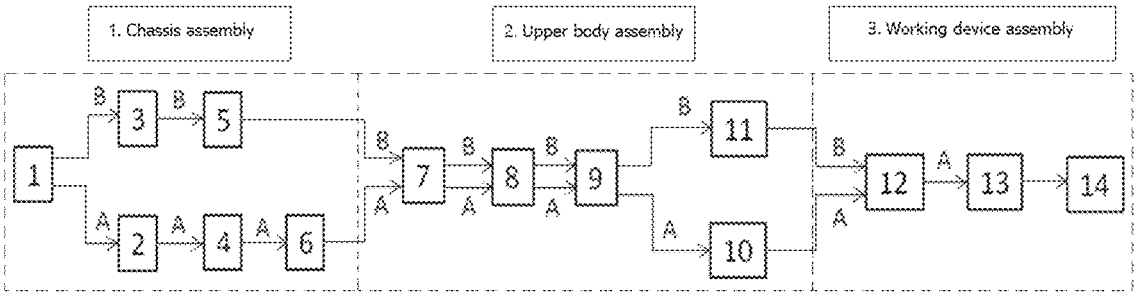
FIG. 2 is a block diagram of assembly steps of the modular excavator of the embodiment of the present disclosure.
Figure 3:
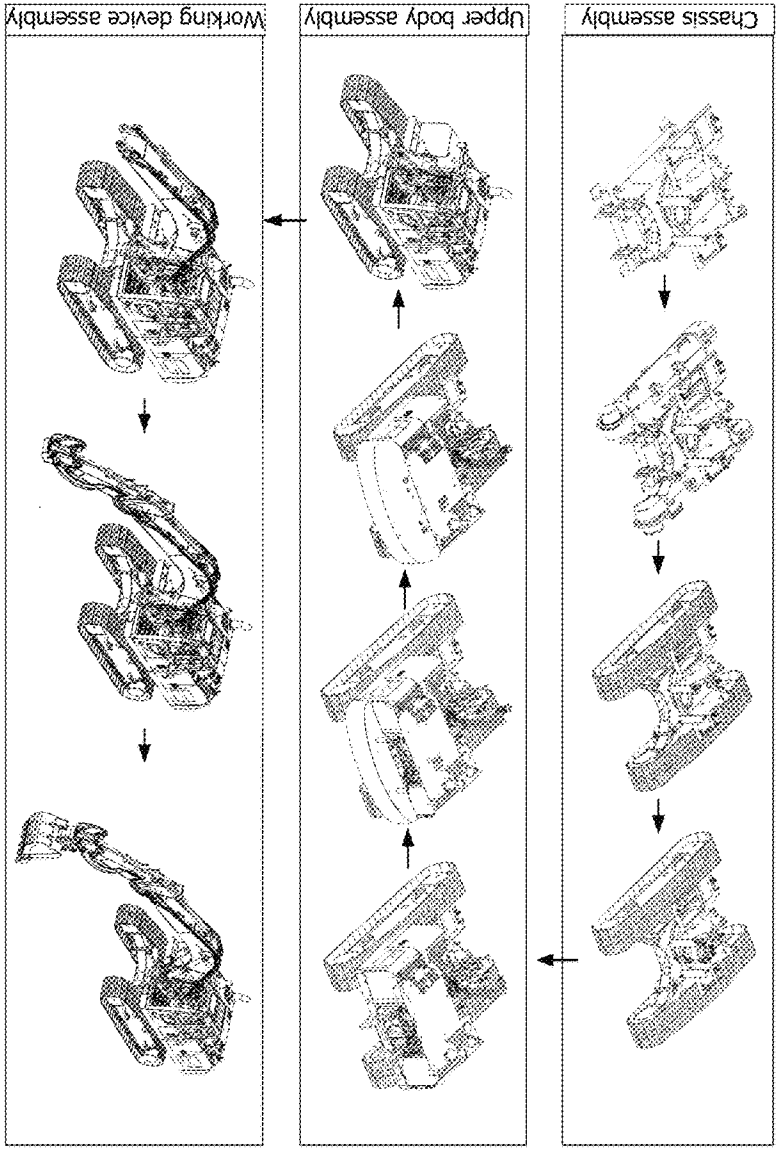
FIG. 3 is a structure diagram of the modular excavator after respective assembly steps are completed.

An assembly process of the modular excavator of the embodiment of the present disclosure will be described below in conjunction with FIGS. 1 to 16. FIG. 2 is a block diagram of assembly steps of the modular excavator. In FIGS. 2, A and B represent two assembly processes that can be carried out in parallel. Numerals in FIG. 2 represent assembly step serial numbers, and an assembly module assembled for a respective step serial number correspond to a symbol of the assembly module. For example, the serial number 3 represents assembling the right track beam assembly module M3. FIG. 3 is a structure diagram of the modular excavator after respective assembly steps are completed.

The assembly modules of the whole machine of the modular excavator are assembled in a mode of asynchronous parallel collaborative work. With hoisting equipment and assembly personnel as well as tooling components provided on a specified site, assembly is carried out from the bottom up according to an assembly sequence process of the assembly modules of the whole machine of the modular excavator, mainly including 3 processes: chassis assembly, upper body assembly, and working device assembly.

1. Chassis Assembly

A height-adjustable bracket device is used to lift the frame turntable base module M1 from its bottom surface and fix it in position at a certain distance from the ground.

The left track beam assembly module M2 and the right track beam assembly module M3 are hoisted and installed at the same time on the left and right sides respectively, and the two track beam assembly modules M2 and M3 are mounted on the lower frame 1A of the frame turntable base module M1. Only the installation of the left track assembly module M2 is described in the following. The installation process of the right track assembly module M3 is same as the installation process of the left track assembly module M2.

The left track beam assembly module M2 is hoisted, and the first guide positioning pin shaft 2-1 at the upper end of the track beam assembly module M2 is placed over the first guide opening 1-1A of the first guide positioning plate 1-1 at the upper end of the left side of the frame turntable base module M1. A lifting rope is relaxed so that the assembly module is free to droop under gravity and the first guide positioning pin shaft 2-1 slides along a guide surface of the first guide opening 10-1A into the arc-shaped first positioning pin slot 1-1B at the bottom of the first guide positioning plate 1-1. Hence, the first cooperating plate 2-2 on a lateral side of the left track beam assembly module M2 abuts against and is fitted to the first positioning plate 1-2 at the lower end of a lateral side of the frame turntable base module M1, and at the same time, the axis of the second locking pin shaft hole of the first pin shaft mounting plate 2-3 at the lower end of a lateral side of the left track beam assembly module M2 coincides with the axis of the first locking pin shaft hole of the first support plate 1-3 at the lower end of a lateral side of the lower frame 1A of the frame turntable base module M1, and the first locking pin shaft 2-5 is inserted therein to achieve a quick mechanical connection between the left track beam assembly module M2 and the frame turntable base module M1. To prevent escape of the first locking pin shaft 2-5 from the corresponding locking pin shaft hole, the locking mechanism may further include a pin shaft limiting stopper 2-4, and the fixing pin shaft limiting stopper 2-4 is fixed to the outer side of the first locking pin shaft 2-5 by a bolt. Then, the first hydraulic line 1F of the frame turntable base module M1 and the second hydraulic line 2H of the left track beam assembly module M2 are quickly connected by a quick connect plug.

The left track module M4 and the right track module M5 are respectively hoisted at one end on a left side and a right side at the same time and wrapped on the left track beam assembly module M2 and the right track beam assembly module M3, and track chain pin shafts and split pins are inserted at joints of both ends of the track chain, and finally grease is pumped into a tensioning device to tension the track, thus completing assembly of the left track module M4 and the right track module M5.

The height of the bracket device is adjusted so that the frame turntable base module M1 is lowered until the two track modules M4 and M5 touch down and are supported on the ground.

The slewing drive module M6 is hoisted separately to the collar 1-7 on the frame turntable base module M1, and the slewing drive module M6 is fixed to the collar 17-7 by a bolt after being quickly positioned by a positioning pin. The hydraulic line of the slewing drive module M6 is quickly connected to the hydraulic lines of the assembled assembly modules by quick connect plugs.

2. Upper Body Assembly

The power assembly module M7 is hoisted collaboratively, and the second guide positioning pin shaft 7-1 at the upper end of the power assembly module M7 is placed over the second guide opening 1-4A at the upper end of the rear side of the frame turntable base module M1. A lifting rope is relaxed so that the power assembly module M7 is free to droop under gravity and the second guide positioning pin shaft 7-1 slides along a guide surface of the second guide opening 1-4A into the arc-shaped second positioning pin slot 1-4B at the bottom. After the second cooperating plate 7-2 on the front side of the power assembly module M7 abuts against and is fitted to the second positioning plate 1-5 on the upper end of the rear side of the frame turntable base module M1, the axis of the fourth locking pin shaft hole at the lower end of the front side of the power assembly module M7 coincides with the axis of the third locking pin shaft hole at the lower end of the rear side of the frame turntable base module M1, and the second locking pin shaft 7-5 is inserted therein, and the second pin shaft limiting stopper 7-4 is fixed thereto. The third hydraulic line 7H of the power assembly module M7 is quickly connected to the hydraulic lines of the assembled assembly modules by quick connect plugs.

The lower counterweight assembly module M8 is hoisted collaboratively to the longitudinal beam at the rear side of the power assembly module M7, and is fixed by a bolt after quickly positioned by a positioning pin.

The upper counterweight assembly module M9 is hoisted collaboratively to a position over the lower counterweight assembly module M8, and the centers of the two positioning holes of the upper counterweight assembly module M9 are aligned with the centers of the two positioning pins of the lower counterweight assembly module M8, and the upper counterweight assembly module is lowered so that the lower bottom surface of the upper counterweight assembly module M9 is fitted to the upper top surface of the lower counterweight assembly module M8, and the upper counterweight assembly module is fixed thereto by a bolt.

The cab module M10 and the fuel tank module M11 are assembled left and right at the same time, respectively, and the quick connection structures for connecting the bottom brackets of the two assembly modules to the turntable main body 1C are same. An assembly method and steps are described by using only the assembly of the fuel tank module M11 and the turntable main body 1C as an example.

Figure 12:
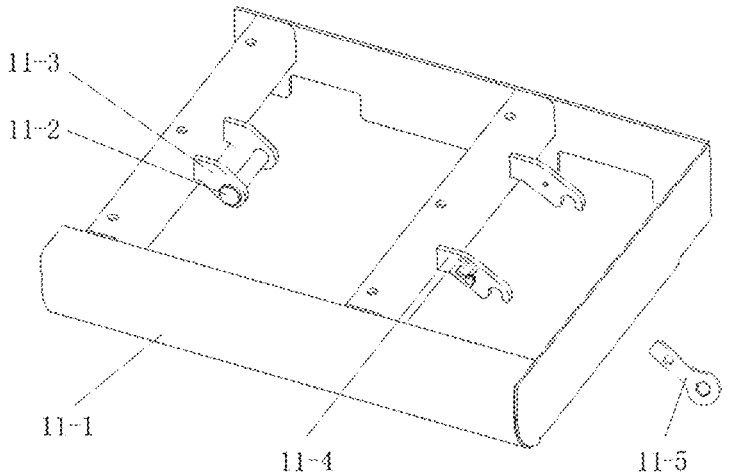
FIG. 12 is a structure diagram of a third bottom bracket of a fuel tank module of the modular excavator of the embodiment of the present disclosure.
Figure 13:
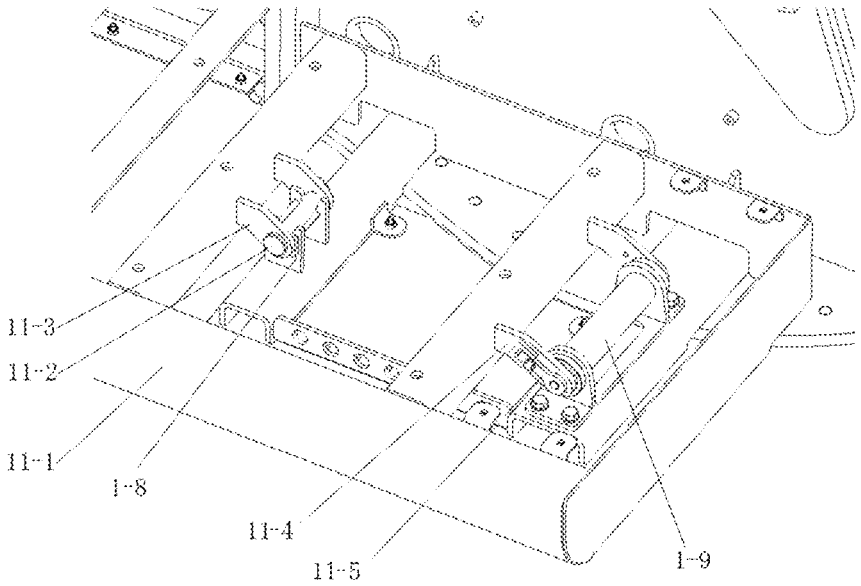
FIG. 13 is a structure diagram of the lower frame of the frame turntable base module and the third bottom bracket of the fuel tank module, of the modular excavator of the embodiment of the present disclosure, after assembled with each other.

As shown in FIGS. 12 and 13, a third quick connection structure that connects the fuel tank module M11 and the turntable main body 1C includes a guide positioning structure and a locking structure.

The guide positioning structure includes two sets of guide elements, each set of guide elements including two mutually cooperating guide elements that are provided on the two assembly modules to be connected, respectively. The two guide elements are configured to guide the two assembly modules to be connected to reach and be positioned at an assembly position.

Figure 14:
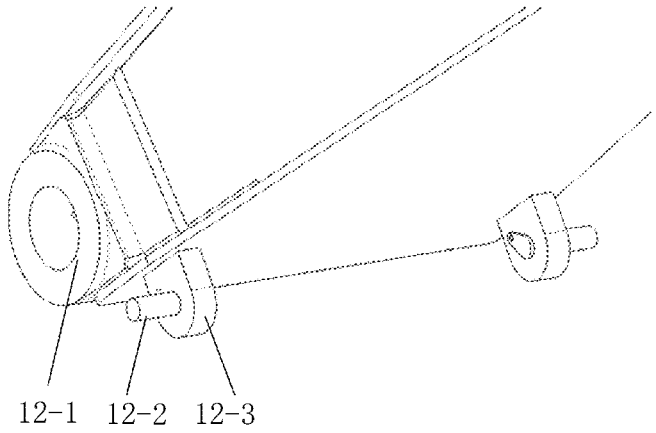
FIG. 14 is a structure diagram of a boom main body of a boom assembly module of the modular excavator of the embodiment of the present disclosure.

The two mutually cooperating guide elements of the guide positioning structure include a guide positioning plate and a guide positioning pin shaft. The guide positioning plate has a guide opening and a positioning pin slot communicated with the guide opening, and the guide positioning pin shaft is configured to enter the positioning pin slot through the guide opening. The guide positioning pin shaft cooperates with the positioning pin slot when the two assembly modules are in the connected state. As shown in FIGS. 13 and 14, in the third quick connection structure, a first set of guide elements includes an articulated shaft 11-2 of a positioning shaft assembly 11-3 arranged on the third bottom bracket 11B of the fuel tank module M11, and a rear mounting seat 1-8, with a guide opening and a positioning pin slot, arranged on the turntable main body 1C. The second set of guide elements includes a front positioning plate 11-4, with a guide opening and a positioning pin slot, arranged on the third bottom bracket 11B of the fuel tank module M11, and a connecting shaft of a front mounting seat 1-9 arranged on the turntable main body 1C.

The locking structure is configured to lock the two assembly modules at the assembly position. The locking structure includes a limiting plate 11-5. The limiting plate 11-5 is configured to connect the front positioning plate 11-4 and the connecting shaft of the front mounting seat 1-9 to lock the relative positions of the two guide elements in at least one degree of freedom.

To install the third bottom bracket 11B of the fuel tank module M11 to the turntable main body 1C, first, the articulated shaft 11-2 of the positioning shaft assembly 11-3 is slid into the positioning pin slot of the rear mounting seat 1-8 through the guide opening of the rear mounting seat 1-8, the articulated shaft being rotatable around the rear mounting seat 1-8. Then the third bottom bracket 11B is lowered so that the connecting shaft of the front mounting seat 1-9 enters the positioning pin slot of the front positioning plate 11-4 through the guiding opening of the front positioning plate 11-4. The connecting shaft is rotated by using the limiting plate 11-5, and the limiting plate 11-5 is fixed to the front positioning plate 11-4 to restrict the connecting shaft from rotation, thus completing the assembly. Hydraulic lines and electrical lines of the assembled assembly modules are quickly connected by quick connect plugs.

3. Working Device Assembly

Front and rear lifting points of the boom assembly module M12 are hoisted collaboratively so that a guide positioning pin shaft 12-2, mounted on a guide positioning pin shaft seat 12-3, near a rear hinge point of the boom assembly module M12 is, referring to FIG. 14, above a guide opening of a guide positioning plate 1-10 near a front hinge point hole of the frame turntable base module M1. A lifting rope is relaxed so that the boom assembly module M12 slides, under gravity, along a guide surface of the guide opening into a positioning pin slot at the bottom of the guide opening. The height of the lifting rope at the front end is adjusted so that a rear hinge point hole rotates around an axis which is the axis of the guide positioning pin shaft 12-2, and the axis of the rear hinge point hole coincides with the axis of the front hinge point hole in the turntable main body 1C. A boom pin shaft is inserted therein and fixed by a pin shaft limiting stopper. The length of the boom cylinder 1E is adjusted and the boom cylinder is hingedly mounted to the boom main body 1A by a pin shaft. The guide positioning plate 1-10 and the guide positioning pin shaft 12-2 form a guide structure when the boom assembly module M12 is connected to the frame turntable base module M1.

A method of installing the bucket arm assembly module M13 to the boom assembly module M12 is substantially same as the method of installing the boom assembly module M12 to the frame turntable base module M1, and will not be described here. Hydraulic lines and electrical lines of the assembled assembly modules are quickly connected by quick connect plugs.

The excavator is started, the boom main body 12A and the bucket arm main body 13A are operated, and the bucket arm assembly module M13 is connected to the work tool module M14 by a quick-change device including the first quick-change device coupling portion 13C and the second quick-change device coupling portion 14B. The assembly of the whole machine of the modular excavator is completed.

According to the above description, the modular excavator of the embodiment of the present disclosure has at least one of the following advantages:

The plurality of assembly modules are independent from each other, and each assembly module has corresponding installation structures and lifting points, which is conducive to meeting the lifting capacity range of transport equipment such as a helicopter, thereby facilitating rapid transit; for example, the assembly modules can be transported by air to a rescue site using a helicopter to perform rapid assembly on the site and quickly put them into construction work, thus solving the problem that large rescue equipment cannot timely reach a site requiring rapid work such as a disaster disposal site of a barrier lake.

The modular excavator has a modular fast disassembly and assembly function. The assembly modules can be marked with assembly serial numbers, and during assembly, some of the assembly modules are quickly connected by a guide positioning mechanism including a guide opening, a positioning pin slot and a guide positioning pin shaft, and a locking mechanism including a self-locking pin shaft and a pin shaft limiting stopper, and their hydraulic lines and electrical lines are quickly disassembled and assembled by quick connect plugs, which effectively reduces the difficulty of field assembly, improves the assembly efficiency, and shortens the assembly time, so that the modular excavator is more quickly put into rescue work, thus greatly reducing damages caused by disasters. With the first quick-change device coupling portion for work tools, a variety of work tools can be quickly assembled and changed, so the machine is multi-functional, and the diversity of rescue work and work efficiency are improved.

Finally, it should be noted that the above embodiments are only used for describing rather than limiting the technical solutions of the present disclosure. Although the present disclosure is described in detail with reference to the preferred embodiments, those of ordinary skill in the art should understand that they still can make modifications to the specific implementations in the present disclosure or make equivalent substitutions to part of technical features thereof; and such modifications and equivalent substitutions should be encompassed within the technical solutions sought for protection in the present disclosure.

The invention claimed is:

1. A modular excavator, comprising a plurality of assembly modules that are detachably connected, the plurality of assembly modules comprising:

a frame turntable base module;

a track beam assembly module configured to be connected to the frame turntable base module;

a track module configured to be connected to the track beam assembly module;

a slewing drive module configured to be connected to the frame turntable base module;

a power assembly module configured to be connected to the frame turntable base module;

a counterweight module configured to be connected to the power assembly module;

a cab module configured to be connected to the frame turntable base module;

a fuel tank module configured to be connected to the frame turntable base module;

a boom assembly module configured to be connected to the frame turntable base module;

a bucket arm assembly module configured to be connected to the boom assembly module; and a work tool module configured to be connected to the bucket arm assembly module;

wherein the modular excavator comprises two counterweight modules, the two counterweight modules comprising a lower counterweight module and an upper counterweight module, with guide posts being provided between connecting surfaces of the lower counterweight module and the upper counterweight module, the lower counterweight module and the upper counterweight module being locked by locking portions; and wherein the locking portion comprises:

a chain;

a hook provided on the lower counterweight module, a first end of the chain being hooked to the hook;

an adjustment plate locked to the upper counterweight module in a position adjustable manner with respect to the upper counterweight module, and having a through hole, a second end of the chain passing through the through hole; and a stopper removably fixed to a side of the adjustment plate away from the hook, and configured to partially cover the through hole to restrict part of links of the chain between the hook and the stopper.

2. The modular excavator according to claim 1, wherein the weight of each assembly module is less than 2.8 tons.

3. The modular excavator according to claim 1, wherein at least two assembly modules are connected by a quick connection structure, the quick connection structure comprising:

a guide positioning structure comprising two mutually cooperating guide elements that are provided on two assembly modules to be connected, respectively, the two guide elements being configured to guide the two assembly modules to be connected to reach and be positioned at an assembly position; and a locking structure configured to lock the two assembly modules at the assembly position.

4. The modular excavator according to claim 3, wherein the two mutually cooperating guide elements of the guide positioning structure comprise a guide positioning plate and a guide positioning pin shaft, the guide positioning plate having a guide opening and a positioning pin slot communicated with the guide opening, and the guide positioning pin shaft being configured to enter the positioning pin slot through the guide opening, and the guide positioning pin shaft cooperating with the positioning pin slot when the two assembly modules are in a connected state.

5. The modular excavator according to claim 4, wherein the guide positioning structure comprises at least two sets of guide elements, two guide elements of each set of guide elements cooperating with each other; and the locking structure comprises a limiting plate, which is configured to connect the two guide elements of the same set of guide elements to lock the relative positions of the two guide elements in at least one degree of freedom.

6. The modular excavator according to claim 3, wherein the guide positioning structure further comprises two mutually cooperating positioning elements that are provided on the two assembly modules, respectively, namely a positioning plate and a cooperating plate, which, when the two assembly modules are in the connected state, abut against each other to position the two assembly modules at the assembly position.

7. The modular excavator according to claim 3, wherein the locking structure comprises two locking portions, with self-locking pin holes, that are provided on the two assembly modules, respectively, and a self-locking pin shaft configured to cooperate with the two self-locking pin holes.

8. The modular excavator according to claim 7, wherein the two locking portions of the locking structure comprise a support plate and a pin shaft mounting plate, and the self-locking pin shaft cooperates with the two self-locking pin holes in the support plate and in the pin shaft mounting plate when the two assembly modules are in the connected state.

9. The modular excavator according to claim 3, wherein the track beam assembly module is connected to the frame turntable base module by the quick connection structure; and/or the power assembly module is connected to the frame turntable base module by the quick connection structure; and/or the cab module is connected to the frame turntable base module by the quick connection structure; and/or the fuel tank module is connected to the frame turntable base module by the quick connection structure.

10. The modular excavator according to claim 1, wherein at least two of the plurality of assembly modules comprise hydraulic lines, the hydraulic lines of the at least two assembly modules being connected by a quick connect plug; and/or at least two of the plurality of assembly modules comprise electrical lines, the electrical lines of the at least two assembly modules being connected by a quick connect plug.

11. The modular excavator according to claim 1, wherein the frame turntable base module comprises a turntable main body, with a collar being provided on the turntable main body, the slewing drive module being positioned to the collar by a positioning pin and connected thereto by a bolt.

12. The modular excavator according to claim 1, wherein the frame turntable base module (M1) comprises a lower frame (1A), a slew bearing assembly (1B), a turntable main body (1C), a central slewing body (1D), a boom cylinder (1E) and a first hydraulic line (1F); the slew bearing assembly (1B), the turntable main body (1C), the central slewing body (1D), the boom cylinder (1E) and the first hydraulic line (1F) are mounted on the lower frame (1A); or wherein the track beam assembly module (M2, M3) comprises a track longitudinal beam (2A), a sprocket (2B), an idler (2C), a track roller (2D), a carrier roller (2E), a travel driving mechanism (2F), and a second hydraulic line (2H), the sprocket (2B), the idler (2C), the track roller (2D), the carrier roller (2E), the travel driving mechanism (2F) and the second hydraulic line (2H) are mounted on the track longitudinal beam (2A), the track longitudinal beam (2A) being connected to the lower frame (1A) of the frame turntable base module (M1) by a quick connection structure; or wherein the power assembly module comprises an engine system, a hood, a first bottom bracket, a hydraulic tank, a hydraulic main valve, a main pump, and a third hydraulic line, the engine system, the hood, the hydraulic tank, the hydraulic main valve, the main pump and the third hydraulic line being mounted on the first bottom bracket, and the first bottom bracket being connected to the lower frame of the frame turntable base module by a quick connection structure.

13. The modular excavator according to claim 1, wherein the modular excavator comprises at least two counterweight modules connected to the power assembly module.

14. The modular excavator according to claim 1, wherein the power assembly module is positioned to at least one counterweight module by a positioning pin and connected thereto by a bolt.

15. The modular excavator according to claim 1, wherein the adjustment plate comprises threaded holes, and the locking portion further comprises locking screws cooperating with the threaded holes, the position of the adjustment plate relative to the upper counterweight module being adjusted and the adjustment plate being locked to the upper counterweight module, by means of the locking screws.

16. The modular excavator according to claim 1, wherein the cab module comprises a cab and a second bottom bracket supporting the cab, the second bottom bracket being connected to a turntable main body of the frame turntable base module by the quick connection structure.

17. The modular excavator according to claim 1, wherein the fuel tank module comprises a fuel tank and a third bottom bracket supporting the fuel tank, the third bottom bracket being connected to a turntable main body of the frame turntable base module by the quick connection structure.

18. The modular excavator according to claim 1, wherein the boom assembly module (M12) comprises a boom main body (12A), a bucket arm cylinder (12B) and a fourth hydraulic line (12C), the bucket arm cylinder (12B) and the fourth hydraulic line (12C) being mounted on the boom main body (12A), and a rear end of the boom main body (12A) being positioned by means of a positioning structure and hinged by means of a pin shaft to a front end of a turntable main body (1C) of the frame turntable base module (M1); or wherein the bucket arm assembly module comprises a bucket arm main body, a bucket cylinder, a first quick-change device coupling portion, and a fifth hydraulic line, the bucket cylinder, the first quick-change device coupling portion and the fifth hydraulic line being mounted on the bucket arm main body, and a rear end of the bucket arm main body being positioned by means of a positioning structure and hinged by means of a pin shaft to a front end of the boom main body; and the work tool module comprises a tool body and a second quick-change device coupling portion provided on the tool body, a front end of the bucket arm main body being connected to the work tool module by the first quick-change device coupling portion and the second quick-change device coupling portion.

* * * * *